US005690752A

United States Patent [19]

Yamamoto et al.

[11] Patent Number: 5,690,752

[45] Date of Patent: Nov. 25, 1997

[54] PERMANENT MAGNET CONTAINING RARE EARTH METAL, BORON AND IRON

[75] Inventors: Kazuhiko Yamamoto; Yuichi Miyake; Chikara Okada, all of Hyogo-ken, Japan

[73] Assignee: Santoku Metal Industry Co., Ltd., Japan

[21] Appl. No.: 508,126

[22] Filed: Jul. 27, 1995

Related U.S. Application Data

[63] Continuation-in-part of Ser. No. 258,774, Jun. 13, 1994, abandoned.

[30] Foreign Application Priority Data

Jun. 14, 1993 [JP] Japan ..... 5-142156

[51] Int. Cl.$^6$ ..... H01F 1/057

[52] U.S. Cl. ..... 148/302; 148/101; 148/103; 419/12; 75/244

[58] Field of Search ..... 148/302, 101, 148/103; 419/12; 75/244

[56] References Cited

U.S. PATENT DOCUMENTS 4,881,986 11/1989 Sato et al. ..... 148/104

4,898,625 2/1990 Otsuka et al. ..... 148/104

4,921,551 5/1990 Vernia ..... 148/101

4,966,633 10/1990 Brewer ..... 148/101

5,022,939 6/1991 Yajima et al. ..... 148/302

*Primary Examiner*—John Sheehan

*Attorney, Agent, or Firm*—Keil & Weinkauf

[57] ABSTRACT

A permanent magnet is obtained by pulverizing, molding and sintering a starting material containing an alloy ingot. The alloy ingot contains not less than 90% by volume of columnar crystals each having a columnar crystal grain size of 0.1 to 50 μm along a short axis thereof and a columnar crystal grain size of larger than 100 μm and not larger than 300 μm along a long axis thereof, and is obtained by uniformly solidifying by a single roll method a molten alloy containing 25 to 31% by weight of a rare earth metal, 0.5 to 1.5% by weight of boron and iron under cooling conditions of a cooling rate of higher than 500° C./sec. and not higher than 10,000° C./sec. and a supercooling degree of 50° to 500° C.

28 Claims, 1 Drawing Sheet

PERMANENT MAGNET CONTAINING RARE EARTH METAL, BORON AND IRON

CROSS-REFERENCE TO RELATED APPLICATION

This application is a continuation-in-part of application Ser. No. 08/258,774, filed on Jun. 13, 1994 now abandoned.

BACKGROUND OF THE INVENTION

This invention relates to a permanent magnet with excellent magnetic properties containing a rare earth metal, boron and iron.

Permanent magnet alloy ingots are generally produced by a metal mold casting method consisting in casting molten alloy in a metal mold. If the molten alloy is to be solidified by the metal mold casting method, it is heat conduction through the casting mold that determines the rate of heat removal during the initial stage of the heat removal process for the molten alloy. However, as solidification proceeds, heat conduction between the casting mold and the solidified phase or in the solidifying phase determines the rate of heat conduction. Even though the cooling capacity of the metal mold is improved, the inner portions of the ingot and those portions of the ingot in the vicinity of the casting mold are subjected to different cooling conditions. Such phenomenon is the more pronounced, the thicker the ingot thickness. The result is that in the case of a larger difference between the cooling conditions in the inner portions of the ingot and those in the vicinity of the ingot surface, there exists a large quantity of initial crystals of γ-Fe in the portion of the cast structure towards the high residual magnetic flux in the magnet composition, with the result, that an α-Fe phase having a grain size of 10 to 300 μm is left in the cast structure at a mid portion of the ingot, while the rare earth metal rich phase surrounding the main phase is also increased in crystal grain size.

On the other hand, the ingot is usually pulverized during the pulverization step in the magnet production process to a grain size of several microns. However, since the ingot produced by the above-mentioned metal mold casting process contains a phase rich in α-Fe and a coarse-grained rare earth metal rich phase, which are difficult to pulverize, there results non-uniform crystal grain distribution of the ingot powders produced on pulverization, with the result that orientation of magnetic domains and sinterability are lowered and hence the magnetic properties of the ultimate permanent magnet are deteriorated.

Although columnar crystals having a short axis length of 0.1 to 50 μm and a long axis length of 0.1 to 100 μm are known to exist in the structure of the ingot produced by the above-mentioned metal mold casting method, the content of these crystals is minor and unable to influence the magnetic properties favorably.

There has also been proposed a method for producing an alloy for a rare earth metal magnet comprising charging a rare earth metal element and cobalt and, if necessary, iron, copper and zirconium, into a crucible, melting the charged mass and allowing the molten mass to solidify so as to have a thickness of 0.01 to 5 mm by e.g. a strip casting system combined with a twin roll, a single roll, a twin belt or the like.

Although an ingot having a more uniform composition may be produced with the above method than that produced by the metal mold casting method, since the components of the starting material consist in the combination of rare earth metal, cobalt and occasionally iron, copper and zirconium, the magnetic properties cannot be improved sufficiently by the strip casting method.

There has also been proposed a magnet produced by pulverizing, molding and sintering an alloy for a magnet containing columnar crystal grains mainly composed of rare earth elements including yttrium and iron and/or cobalt and boron, and a crystal grain boundary mainly consisting of a rare earth metal rich phase, with a mean radius of the columnar crystal grain, that is a length along the long axis of the crystal, being 3 to 50 μm. It has been known to produce the alloy for the magnet by processing the molten alloy under controlling the cooling rate using a single roll or a twin roll.

However, with the conventional method of producing the alloy for the magnet by controlling only the cooling rate using the single roll or the twin roll, it is difficult to produce the columnar crystal grain having the long axis length exceeding 100 μm. If the long axis length of the columnar crystal grains is short, such that the mean diameter of the columnar crystal grain is between 3 and 50 μm, the ultimate anisotropic permanent magnet becomes inferior in magnetic properties.

On the other hand, even if, in producing a magnet, alloy powders having a given composition is molded in a magnetic field and sintered subsequently, sintering cannot proceed and hence a sintered body having satisfactory characteristics cannot be produced, unless a compound functioning as a sintering aid or a low-melting substance is present in a finely divided form in the crystal grain boundary.

SUMMARY OF THE INVENTION

It is an object of the present invention to provide a permanent magnet which may be produced under easily controlled conditions for pulverization during production and which exhibits excellent residual magnetic flux density and coercive force, and above all, excellent anisotropic properties.

It is another object of the present invention to provide a permanent magnet which can be sintered satisfactorily during production and exhibit superior residual magnetic flux density and coercive force.

The above and other objects of the present invention will become apparent from the following description.

According to the present invention, there is provided a permanent magnet obtained by pulverizing, molding and sintering a starting material comprising 70 to 99.9 vol. % of an alloy ingot. The alloy ingot contains not less than 90% by volume of columnar crystals each having a columnar crystal grain size of 0.1 to 50 μm along a short axis thereof and a columnar crystal grain size of larger than 100 μm and not larger than 300 μm along a long axis thereof, and is obtained by uniformly solidifying by a single roll method a molten alloy containing 25 to 31% by weight of a rare earth metal, 0.5 to 1.5% by weight of boron and iron under cooling conditions of a cooling rate of higher than 500° C./sec. and not higher than 10,000° C./sec. and a supercooling degree of 50° to 500° C.

BRIEF DESCRIPTION OF THE DRAWING

The sole FIGURE is a schematic view showing the production of an alloy ingot for a permanent magnet by a strip casting method using a single roll according to an embodiment of the present invention.

PREFERRED EMBODIMENTS OF THE INVENTION

Figure 1:
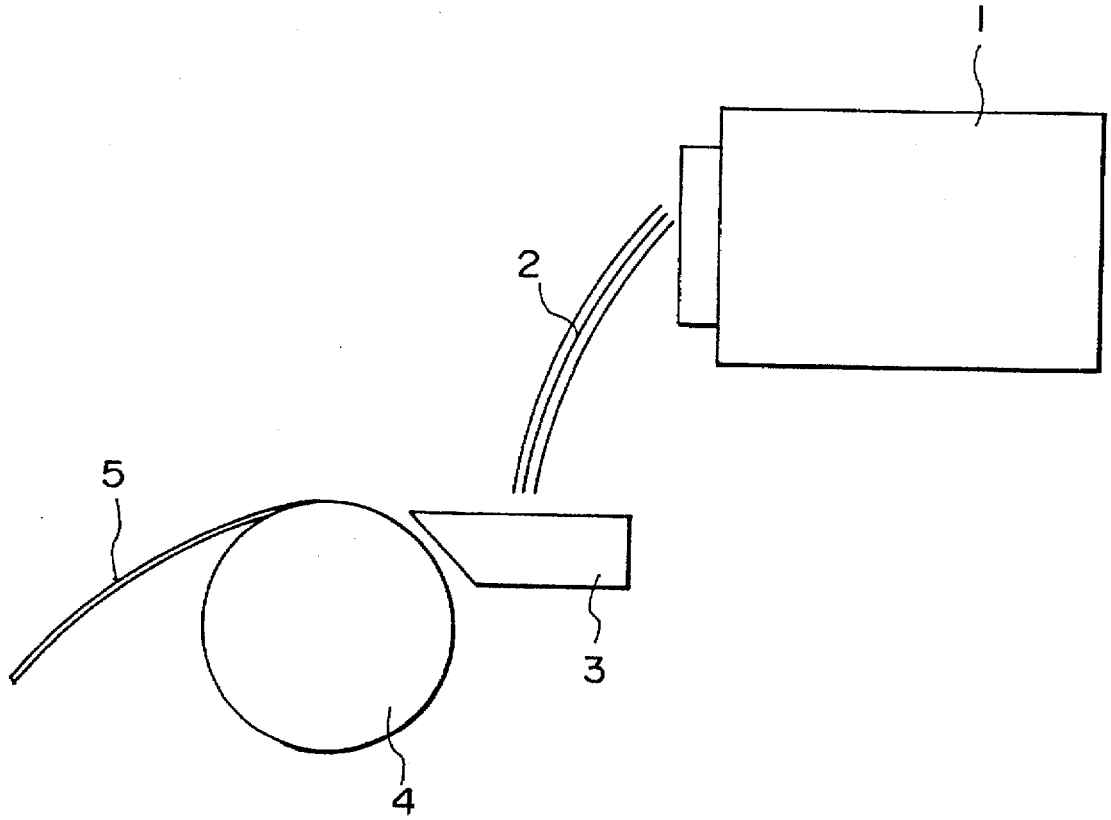

The present invention will be explained in detail hereinbelow.

The permanent magnet according to the present invention is obtained by pulverizing, molding and sintering a starting material containing an alloy ingot synthesized by a specified production process, and exhibits superior anisotropy, while exhibiting a high degree of anisotropy and superior residual magnetic flux density and coercive force as compared to a magnet produced from a starting material of a columnar crystal-containing alloy ingot produced under controlling the cooling rate.

The molten alloy for producing the alloy ingot, employed in the present invention, contains 25 to 31 wt % of a rare earth metal, 0.5 to 1.5 wt % of boron, and iron, as essential ingredients. The rare earth metals preferably include lanthanum, cerium, praseodymium, neodymium, yttrium, dysprosium, mischmetal, and mixtures thereof. If the content of the rare earth metal is less than 25 wt %, an iron-rich phase, such as α-iron phase, is precipitated in the produced alloy ingot, thereby adversely affecting the subsequent crushing-process. If the content of the rare earth metal exceeds 31 wt %, the residual magnetic flux density is lowered. If the boron content is less than 0.5 wt %, high coercive force is not obtained, whereas, if it exceeds 1.5 wt %, high residual magnetic flux density is not obtained. If the molten alloy does not contain additional components other than the above-mentioned essential components, the iron content is 67.5 to 74.5 wt %. However, if the molten alloy contains the additional components other than the essential components, the iron content is preferably at least 37.5 wt % or more. That is, the amount of the additional components is not more than 30 wt % and preferably not more than 10 wt % and more preferably not more than 6 wt %. Examples of these additional components include cobalt, aluminum, chromium, manganese, magnesium, silicon, copper, carbon, tin, tungsten, vanadium, zirconium, titanium, molybdenum, niobium, gallium and mixtures thereof. Of these, cobalt is most preferred. Inevitable impurities or trace components, such as oxygen, may also be contained besides these additional components.

The molten alloy may be prepared by, for example, vacuum melting, high frequency melting or the like, under an inert atmosphere, preferably using a crucible or the like.

The alloy ingot, which is the starting material according to the present invention, is produced under controlling the supercooling degree of the molten alloy to 50° to 500° C. The lower limit of the supercooling degree is preferably controlled to 100° C. for increasing the ratio of the length along the long axis to that along the short axis of the produced columnar crystal and for improving the degree of anisotropy and dispersibility of the rare earth metal rich phase to thereby improve magnetic properties of the permanent magnet as an ultimate product. The upper limit, on the other hand, is controlled to 500° C. for obtaining the length along the short axis of the produced columnar crystals of not less than 0.1 μm and for improving the magnetic properties of the ultimate permanent magnet. The molten alloy having such specified supercooling degree is uniformly solidified by the single roll method under cooling conditions exceeding 500° C./sec. and not higher than 10,000° C./sec. and preferably in a range of from 1,000° to 5,000° C./sec. for producing the desired alloy ingot.

The supercooling degree herein means a value defined by (melting point of the alloy)—(actual temperature of the molten alloy not higher than its melting point). More specifically, the supercooling means a phenomenon in which solidification is actually not produced even when the molten alloy is cooled down to the melting point of the alloy and, when the temperature is further lowered to a nucleation temperature, a fine-grained solid phase, that is a crystal, is formed in the molten alloy to initiate the solidification. The supercooling degree means the difference between the melting point of the alloy and the actual temperature of the molten alloy lower than its melting point, as defined previously. According to the present invention, an alloy ingot which is hitherto not known and which has the content of not less than 90 vol % of a crystal having a crystal grain size within a range as specified subsequently may be produced by controlling the difference, that is the supercooling degree, of the molten alloy, to a range of from 50° to 500° C., and setting the cooling rate so as to exceed 500° C./sec. and so as not to exceed 10,000° C./sec.

The supercooling degree of the molten alloy may be controlled to the above-mentioned specified temperature by controlling the temperature of the molten alloy prepared using the aforementioned crucible and by suitably controlling the time and the feed rate of the molten alloy until the molten alloy reaches the single roll for solidification.

The molten alloy controlled to the above-mentioned specified supercooling degree may be solidified by the single roll method at the aforementioned specified cooling rate by controlling the number of revolutions and the surface temperature of the roll, the temperature of the atmosphere or the feed amount of the molten alloy to the roll for controlling the thickness of the produced alloy ingot. The reason why the single roll method is adopted is that, with the twin roll method or the rotary disc method, the crystal growth direction or the cooling rate is difficult to control and a target crystal structure cannot be obtained, while the device itself is inferior in durability, and that with the single roll method the conditions of controlling the supercooling degree to the above-mentioned value and of continuously solidifying the molten alloy with the aforementioned specified cooling rate may be set more easily. The alloy ingot preferably has a thickness ranging between 0.05 to 5 mm for more facilitated control of the cooling rate to the above-mentioned value. The thickness of the alloy ingot in excess of 5 mm is not desirable because it becomes difficult to produce the alloy ingot having a desired crystal structure which will be explained subsequently.

The alloy ingot produced by the above-mentioned method contains not less than 90 vol % and preferably not less than 98 vol % of columnar crystals each having a length along the short axis of 0.1 to 50 μm, preferably 1 to 20 μm, and a length along the long axis of exceeding 100 μm, preferably exceeding 150 μm and preferably not more than 300 μm and more preferably not more than 250 μm. It is particularly preferred that the alloy ingot be completely free from α-Fe and/or γ-Fe usually contained as peritectic nuclei in the crystal grain of the main phase. If the alloy ingot contains α-Fe and/or γ-Fe, it is desirable that such α-Fe and/or γ-Fe have a grain size less than 10 μm and be present in a finely dispersed state. Such crystal structure may be confirmed by a photograph taken with an electronic microscope. If the lengths along the long and short axes are outside of the above ranges, the ultimate permanent magnet is deteriorated in magnetic properties. Above all, if the length along the long axis is 100 μm or less, the columnar crystal is lowered in the aspect ratio and the columnar crystal becomes similar to the granular crystal while the degree of anisotropy is lowered such that high magnetic properties cannot be produced. If the content of the crystals having the above-mentioned crystal grain size is less than 90 vol %, superior magnetic properties cannot be afforded to the produced alloy ingot. In addition, if the α-Fe and/or γ-Fe has a grain size not less than 10 μm, and is not dispersed finely, grain size distribution becomes nonuniform at the time of pulverization of the production process for the permanent magnet, while excellent anisotropy also cannot be produced.

There is no limitation to the content of the above-mentioned alloy ingot in the starting material, if such alloy ingot is present as a main component. However, the content of the alloy ingot is preferably 70 to 99.9 vol % for further improving magnetic properties of the permanent magnet as an ultimate product.

0.1 to 30 vol % of an additional metal ingot may also be contained in the starting material in addition to the aforementioned alloy ingot. Such additional metal ingot may preferably contain an additional rare earth metal, such as lanthanum, cerium, praseodymium, neodymium, yttrium, dysprosium, mischmetal or mixtures thereof, in an amount of 31 to 100 wt % based upon the amount of the additional metal ingot. The additional metal ingot may contain not more than 69 wt % of, for example, iron, cobalt, nickel or mixtures thereof in addition to the rare earth metals. Such additional metal ingot may be prepared by a method similar to the above-mentioned method for preparing the alloy ingot as the main component, while it may also be prepared by known metal casting methods, such as the twin roll method or rotary disc method. If the starting material contains the above-mentioned additional metal ingot, the resulting permanent magnet may be improved in magnetic properties than if the above-mentioned main component alloy ingot by itself is employed. The additional metal ingot contained in an amount exceeding 30 vol % based upon the amount of the starting material is not desirable in that the magnetic properties are thereby deteriorated.

The permanent magnet of the present invention is prepared by pulverizing, molding and sintering the starting material containing the above-mentioned alloy ingot in a usual manner.

The above-mentioned pulverization may be performed by mechanically crushing the starting material by any known mechanical crushing means. Preferably, the starting material is crushed to 24 to 250 meshes and subsequently pulverized to a size of 10 μm or less and preferably to 2 to 3 μm. Separate batches of the starting materials may also be pulverized and mixed so as to be supplied to the next proceeding molding step. If the starting material contains the additional metal ingot, the additional metal ingot and the main component metal ingot are preferably crushed separately and mixed and the resulting mixture is then pulverized to the above-mentioned particle size. Since the alloy ingot has the specified polycrystal structure and is free from peritectic nuclei or is finely dispersed, it is possible to produce alloy powders having substantially homogeneous particle size easily in a shorter time, and to suppress the amount of oxygen otherwise mixed into the alloy powders during crushing. Such pulverization leads to improved magnetic properties of the ultimate permanent magnet.

The aforementioned molding may be carried out by usual compression molding in a magnetic field. The strength of the magnetic field is preferably 1,200 $KAm^{-1}$ or higher and more preferably 1,500 $KAm^{-1}$ or higher, while the molding pressure is preferably 100 to 200 MPa.

There is no limitation to the sintering method and any of well-known sintering methods may be employed. Preferably, sintering is performed under conditions of the temperature of 1,000° to 1,200° C. for 0.5 to 5 hours in an inert gas atmosphere or in vacuum. Since the above-mentioned alloy powders are pulverized substantially homogeneously, the sintering may proceed smoothly, while the sintered product has a uniform crystal grain size. The sintered mass may be heat-treated in any known method after sintering for further improving the magnetic properties. Such heat treatment may be conducted preferably under conditions of the temperature of 400° to 600° C. and for 0.5 to 5 hours.

The permanent magnet of the present invention is prepared by employing, as an essential component of the starting material, an alloy ingot of a novel crystal structure prepared by a specified production method, above all, the single roll method, under controlling the supercooling degree and the cooling rate of the molten alloy. Since the pulverizing step during production may be carried out easily, and the sintering proceeds satisfactorily, the permanent magnet is superior in magnetic properties, such as residual magnetic flux density or coercive force, and exhibits particularly excellent anisotropy. By employing the additional metal ingot bedsides the aforementioned main component alloy ingot, the permanent magnet itself may be given further improved magnetic properties. Thus the permanent magnet according to the present invention may be expected to be utilized in many fields in which a demand is raised for magnetic properties more excellent than those of the conventional permanent magnet.

EXAMPLES OF THE INVENTION

The present invention will be explained in further detail with reference o Examples and Comparative Examples. These Examples, however, are given only for illustration and are not intended for limiting the invention.

Example 1

A mixture of metals having the composition of 30.8 wt % of neodymium, 1.0 wt % of boron and 68.2 wt % of iron was melted by a high frequency melting method in an argon atmosphere using an alumina crucible. The resulting molten mass maintained at a temperature of 1,350° C. was processed in accordance with the following method, using an apparatus shown in FIG. 1, in order to produce an alloy ingot for a permanent magnet. The composition of the starting material is shown in Table 1.

FIG. 1 is a schematic view showing an alloy ingot for a permanent magnet being prepared by a strip casting method employing a single roll. A molten mass 2 melted by the high frequency melting method is contained in a crucible 1, and maintained at 1350° C. The molten mass 2 was continuously poured on to a tundish 3 while the supercooling degree was adjusted to 200° C. The molten mass 2 was supplied to a roll 4 rotated at a peripheral speed of approximately 3 m/sec. The molten mass was allowed to solidify on the roll 4 so that the cooling rate of 1000° C./sec was maintained. The molten mass 2 was allowed to descend continuously in the rotating direction of the roll 4 in order to produce an alloy ingot 5 having a thickness of 0.2 to 0.5 mm. The supercooling degree and the cooling rate during the production of the alloy ingot and the grain size of the crystal structure of the alloy ingot as measured with the electron microscope are shown in Table 2, and the structural characteristics of the crystal structure as observed by the electron microscope are shown in Table 3. It is seen from the values of the mean diameter and the standard deviation of the crystal structure shown in Table 2 that the produced alloy ingot contains 90 vol % or more of the columnar crystal grains having the columnar crystal grain size of 0.1 to 50 μm along the short axis and more than 100 μm and not more than 300 μm along the long axis.

The produced alloy ingot for a permanent magnet was crushed to a size of 24 to 250 meshes and further pulverized in alcohol to approximately 3 μm. The produced fine powders were molded in a magnetic field under conditions of 150 MPa and 2,400 $KAm^{-1}$ and sintered for two hours at 1,040° C. in order to produce a permanent magnet 10×10×15 mm in size. The magnetic properties of the produced permanent magnet are shown in Table 4.

Examples 2 and 3

Samples of the permanent magnet were prepared in the same way as in Example 1 except employing the composition of the starting material shown in Table 1 and the supercooling degree and the cooling rate as shown in Table 2. The crystal grain size of the alloy ingot, the structural characteristics of the crystal structure and the magnetic properties of the produced permanent magnet samples are shown in Tables 2, 3 and 4, respectively. It is seen from the values of the mean diameter and the standard deviation of the crystal structure shown in Table 2 that the produced alloy ingot contains 90 vol % or more of the columnar crystal grains having the columnar crystal grain size of 0.1 to 50 μm along the short axis and more than 100 μm and not more than 300 μm along the long axis.

Comparative Example 1

A metal mixture having the same composition as that of Example 1 was melted by a high frequency melting method and cast by the metal mold casting method to produce an alloy ingot for a permanent magnet having a thickness of 25 mm. The resulting alloy ingot was analyzed in the same way as in Example 1, and further processed to produce a permanent magnet. The composition of the alloy ingot is shown in Table 1, while the supercooling degree, the cooling rate and the crystal grain size of the alloy ingot are shown in Table 2. The structural characteristics of the crystal structure and the magnetic characteristics of the produced permanent magnet sample are shown in Tables 3 and 4, respectively.

Comparative Example 2

A permanent magnet sample was prepared in the same way as in Example 1, except using the starting material composition shown in Table 1, employing the molten temperature of 1,200° C. and the peripheral speed of the roll of 0.01 m/sec. and setting the supercooling degree and the cooling rate shown in Table 2. The crystal grain size of the alloy ingot, the structural characteristics of the crystalline structure and the magnetic properties of the produced permanent magnet sample are shown in Tables 2, 3 and 4, respectively.

Comparative Example 3

A permanent magnet sample was prepared in the same way as in Example 1, except using the starting material composition shown in Table 1, employing the molten temperature of 1,600° C. and the peripheral speed of the roll of 50 m/sec. and setting the supercooling degree and the cooling rate shown in Table 2. The crystal grain size of the alloy ingot, the structural characteristics of the crystalline structure and the magnetic properties of the produced permanent magnet sample are shown in Tables 2, 3 and 4, respectively.

Comparative Example 4

An alloy ingot for a permanent magnet was prepared in the same way as in Comparative Example 1, except using the composition of the starting material shown in Table 1, and further processed to produce a permanent magnet. The composition of the alloy ingot is shown in Table 1, while the supercooling degree, the cooling rate and the crystal grain size of the alloy ingot are shown in Table 2. The structural characteristics of the crystalline structure and the magnetic characteristics of the produced permanent magnet sample are shown in Tables 3 and 4, respectively.

TABLE 1

| | Nd | Dy | Fe | Co | B |
|---|---|---|---|---|---|
| Ex. 1 | 30.8 | | 68.2 | | 1.0 |
| Ex. 2 | 30.0 | | 58.8 | 10.0 | 1.2 |
| Ex. 3 | 27.0 | 3.0 | 68.8 | | 1.2 |
| Comp. Ex. 1 | 30.0 | | 68.8 | | 1.2 |
| Comp. Ex. 2 | 30.0 | | 68.8 | | 1.2 |
| Comp. Ex. 3 | 30.0 | | 68.8 | | 1.2 |
| Comp. Ex. 4 | 27.0 | 3.0 | 68.8 | | 1.2 |

TABLE 2

| | | | Main phase grain size (μm) | | | | | | | |
|---|---|---|---|---|---|---|---|---|---|---|
| | | | Long axis | | | | Short axis | | | |
| | Cooling rate (°C./Sec.) | Supercooling degree (°C.) | Max. Value | Min. Value | Average | Standard deviation | | | | deviation |
| Ex. 1 | 1000 | 200 | 300 | 10 | 180 | 20 | 10 | 3 | 7 | 2 |
| Ex. 2 | 4821 | 165 | 270 | 18 | 165 | 16 | 10 | 2 | 3 | 1 |
| Ex. 3 | 4635 | 155 | 250 | 14 | 200 | 25 | 8 | 2 | 4 | 2 |
| Comp. Ex. 1 | 6 | 8 | 450 | 50 | 300 | 80 | 250 | 50 | 190 | 50 |
| Comp. Ex. 2 | 30 | 0 | 150 | 100 | 120 | 14 | 120 | 5 | 100 | 20 |
| Comp. Ex. 3 | 40000 | 600 | 3 | 0.1 | 0.8 | 0.4 | 1.6 | 0.06 | 0.8 | 0.2 |
| Comp. Ex. 4 | 6 | 5 | 370 | 60 | 160 | 60 | 280 | 40 | 200 | 60 |

TABLE 3

| | Structural ch racteristic | |
|---|---|---|
| | Grain size of α-Fe (μm) | Rare earch-enriched phase |
| Ex. 1 | Not observed | Uniform |
| Ex. 2 | " | " |
| Ex. 3 | " | " |
| Comp. Ex. 1 | 200 300 | Segregated |
| Comp. Ex. 2 | 5 100 | Uniform |
| Comp. Ex. 3 | Amorphous | " |
| Comp. Ex. 4 | 200 300 | Segregated |

TABLE 4

| | Magnetic char cteristic | | |
|---|---|---|---|
| | Br (KG) | iHc (KOe) | (BH) max (MGOe) |
| Ex. 1 | 12.9 | 15.0 | 41.0 |
| Ex. 2 | 13.4 | 13.0 | 40.2 |
| Ex. 3 | 13.2 | 14.0 | 39.8 |
| Comp. Ex. 1 | 11.8 | 8.3 | 30.7 |
| Comp. Ex. 2 | 12.6 | 7.9 | 28.6 |
| Comp. Ex. 3 | 8.9 | 1.9 | 4.1 |
| Comp. Ex. 4 | 11.5 | 9.6 | 30.6 |

TABLE 6

| | Cooling rate (°C./Sec.) | Supercooling degree (°C.) | Peripheral speed of roll(s) (m/sec.) | Main phase grain size (μm) | | | | | | | |
|---|---|---|---|---|---|---|---|---|---|---|---|
| | | | | Long axis | | | | Short axis | | | |
| | | | | Max. Value | Min. Value | Average | Standard deviation | Max. Value | Min. Value | Average | Standard deviation |
| Ex. 4 | 3628 | 250 | 3 | 320 | 20 | 190 | 40 | 8 | 2 | 4 | 2 |
| Comp. Ex. 5 | 8000 | 400 | 2 | 3 | 0.5 | 2 | 1 | 3 | 1 | 2 | 1 |

Example 4

A sample of the permanent magnet was prepared in the same way as in Example 1 except employing the composition of the starting material shown in Table 5 and the supercooling degree, the cooling rate, and the peripheral speed of the roll as shown in Table 6. The crystal grain size of the alloy ingot, the structural characteristics of the crystal structure and the magnetic properties of the produced permanent magnet sample are shown in Tables 6, 7, and 8, respectively. It is seen from the value of the mean diameter and the standard deviation of the crystal structure shown in Table 6 that the produced alloy ingot contains 90 vol % or more of the columnar crystal grains having the columnar crystal grain size of 0.1 to 50 μm along the short axis and more than 100 μm and not more than 300 μm along the long axis.

Comparative Example 5

A mixture of metals having the composition of 32.0 wt % of neodymium, 1.0 wt % of boron, and 67.0 wt % of iron was melted by a high frequency melting method in an argon atmosphere using an alumina crucible. The composition of the starting material is shown in Table 5. The resulting molten mass was contained in the crucible, and maintained at a temperature of 1,350° C. The molten mass was ejected from the orifice at the bottom of the crucible onto the chill surface of a first roll rotating at a peripheral speed of 2 m/sec. to be formed into a thin flake form, and thereafter a free surface of the flake came into contact with the outer surface of a second roll rotating at a peripheral speed of 2 m/sec. Accordingly, the free surface of the flake was also rapidly quenched by the second roll but delayed from the opposite surface impinging upon the first roll. The supercooling degree, the cooling rate, and the peripheral speed of the rolls during the production of the alloy flake and the grain size of the crystal structure of the alloy flake as measured with the electron microscope are shown in Table 6, and the structural characteristics of the crystal structure as observed by the electron microscope are shown in Table 7.

The produced alloy flake for a permanent magnet was made into a permanent magnet according to the process of Example 1. The magnetic properties of the produced permanent magnet are shown in Table 8.

TABLE 5

| | Nd | Dy | Fe | Co | B |
|---|---|---|---|---|---|
| Ex. 4 | 32.0 | 0.0 | 67.0 | 0.0 | 1.0 |
| Comp. Ex. 5 | 32.0 | 0.0 | 67.0 | 0.0 | 1.0 |

TABLE 7

| | Grain size of α-Fe (μm) | Rare earch-enriched phase |
|---|---|---|
| Ex. 4 | Not observed | Uniform |
| Comp. Ex. 5 | Not observed | Uniform |

TABLE 8

| | Magnetic characteristic | | |
|---|---|---|---|
| | Br (KG) | iHc (KOe) | (BH) max (MGOe) |
| Ex. 4 | 12.5 | 17.0 | 40.5 |
| Comp. Ex. 5 | 12.0 | 14.0 | 36.0 |

Example 5

A metal mixture having a composition of 28.0 wt % of neodymium, 0.95 wt % of boron and 71.05 wt % of iron was melted in an argon atmosphere by a high frequency melting method, using an alumina crucible. The produced molten mass was processed with the single roll method as in Example 1, under the supercooling degree and the cooling rate as shown in Table 10, in order to producer an alloy ingot for a main phase for the permanent magnet.

A metal mixture having a composition of 40.0 wt % of neodymium, 1.5 wt % of boron and 58.5 wt % of iron was melted in an argon atmosphere by a high frequency melting method, using an alumina crucible. The produced molten mass was processed with the single roll method as in Example 1 under the supercooling degree and the cooling rate shown in Table 10, in order to producer a sintering assist alloy ingot for permanent magnet. The composition of the main phase alloy ingot for permanent magnet and the composition of the sintering assist alloy ingot for permanent magnet are shown in upper and lower lines in each column for each Example shown in Table 9.

The main phase alloy ingot for permanent magnet and the sintering assist alloy ingot for permanent magnet thus produced were separately crushed to a size of 24 to 250 meshes in size and weighed out to give 83 wt % of the main phase alloy ingot for permanent magnet and 17 wt % of the sintering assist alloy ingot, which were mixed together and further pulverized in alcohol to a size in the order of 3 μm. The produced fine powders were pressed in a magnetic field under conditions of 150 MPa and 2400 $KAm^{-1}$ and sintered at 1040° C. for two hours to produce a 10×10×15 mm size permanent magnet. The supercooling degree and the cooling rate employed during preparation of the alloy ingots and the crystal grain size of the produced alloy ingots are shown in Table 10, while the structural characteristics of the alloy ingots and the mixing ratio of the main phase alloy ingot for permanent magnet and the sintering assist alloy ingot for permanent magnet are shown in Table 11 and the magnetic characteristics of the permanent magnet are shown in Table 12. It is seen from the values of the mean diameter and the standard deviation of the crystal structure shown in Table 10 that the produced alloy ingot contains 90 vol % or more of the columnar crystal grains having the columnar crystal grain size of 0.1 to 50 μm along the short axis and more than 100 μm and not more than 300 μm along the long axis.

Example 6

A permanent magnet sample was prepared in the same way as in Example 5 except employing the compositions of the main phase alloy ingot for permanent magnet and the composition of the sintering assist alloy ingot for permanent magnet shown in Table 9 and employing the supercooling degree and cooling rate shown in Table 10 and the mixing ratio of the main phase alloy ingot for permanent magnet and the sintering assist alloy ingot for permanent magnet shown in Table 11. The supercooling degree and the cooling rate employed during preparation of the alloy ingots and the crystal grain size of the produced alloy ingots are shown in Table 10, while the structural characteristics of the alloy ingots and the mixing ratio of the main phase alloy ingot for permanent magnet and the sintering assist alloy ingot for permanent magnet are shown in Table 11 and the magnetic characteristics of the permanent magnet are shown in Table 12. It is seen from the values of the mean diameter and the standard deviation of the crystal structure shown in Table 10 that the produced alloy ingot contains 90 vol % or more of the columnar crystal grains having the columnar crystal grain size of 0.1 to 50 μm along the short axis and more than 100 μm and not more than 300 μm along the long axis.

Examples 7 to 23

Permanent magnet alloy samples were prepared in the same way as in Example 5, except using the compositions of the main phase alloy ingots for permanent magnet and the sintering assist alloy ingots for permanent magnet shown in Table 9, and the supercooling degree and the cooling rate shown in Table 10. Besides, for preparing the permanent magnet alloy samples, each main phase alloy ingot for permanent magnet and each sintering assist alloy ingot for permanent magnet were crushed to produce crushed products, which were then pulverized separately and mixed together at a mixing ratio for the main phase alloy ingot for permanent magnet and the sintering assist alloy ingot for permanent magnet shown in Table 11 and molded in a magnetic field. The supercooling degree and the cooling rate employed during preparation of the alloy ingots and the crystal grain size of the produced alloy ingots are shown in Table 10, while the structural characteristics of the alloy ingots and the mixing ratios of the main phase alloy ingots for permanent magnet and the sintering assist alloy ingots for permanent magnet are shown in Table 11 and the magnetic characteristics of the permanent magnets are shown in Table 12. It is seen from the values of the mean diameter and the standard deviation of the crystal structure shown in Table 10 that the produced alloy ingots contain 90 vol % or more of the columnar crystal grains having the columnar crystal grain size of 0.1 to 50 μm along the short axis and more than 100 μm and not more than 300 μm along the long axis.

TABLE 9

| | La | Ce | Pr | Nd | Dy | Mm* | Fe | Co | B |
|---|---|---|---|---|---|---|---|---|---|
| Ex. 5 | | | | 28.0 | | | 71.05 | | 0.95 |
| | | | | 40.0 | | | 58.50 | | 1.50 |
| Ex. 6 | | | | 28.0 | | | 60.80 | 10.0 | 1.20 |
| | | | | 90.0 | | | | 10.0 | |
| Ex. 7 | | | | 28.0 | | | 60.80 | 10.0 | 1.20 |
| | | | | 90.0 | | | | 10.0 | |
| Ex. 8 | | | | 28.0 | | | 60.80 | 10.0 | 1.20 |
| | | | | | 90.0 | | | 10.0 | |
| Ex. 9 | | | | 28.0 | | | 70.80 | | 1.20 |
| | 80.0 | | | | 20.00 | | | | |
| Ex. 10 | | | | 28.0 | | | 70.80 | | 1.20 |
| | | 80.0 | | | | | 20.00 | | |
| Ex. 11 | | | | 28.0 | | | 70.80 | | 1.20 |
| | | | 80.0 | | | | 20.00 | | |
| Ex. 12 | | | | 28.0 | | | 70.80 | | 1.20 |
| | | | | 80.0 | | | 20.00 | | |
| Ex. 13 | | | | 28.0 | | | 71.00 | | 1.00 |
| | | | | 72.0 | | | 12.00 | | 16.00 |
| Ex. 14 | | | | 28.0 | | | 71.00 | | 1.00 |
| | | | | 72.0 | | | 12.00 | | 16.00 |
| Ex. 15 | | | | 28.0 | | | 60.80 | 10.0 | 1.20 |
| | 90.0 | | | | | | | 10.0 | |
| Ex. 16 | | | | 28.0 | | | 60.80 | 10.0 | 1.20 |
| | | 90.0 | | | | | | 10.0 | |
| Ex. 17 | | | | 28.0 | | | 60.80 | 10.0 | 1.20 |
| | | | 90.0 | | | | | 10.0 | |
| Ex. 18 | | | | 28.0 | | | 60.80 | 10.0 | 1.20 |
| | | | | 80.0 | | | | 10.0 | |
| Ex. 19 | | | | 28.0 | | | 60.80 | 10.0 | 1.20 |
| | 70.0 | | | | 20.0 | | | 10.0 | |
| Ex. 20 | | | | 28.0 | | | 70.80 | | 1.20 |
| | 100.0 | | | | | | | | |
| Ex. 21 | | | | 28.0 | | | 70.80 | | 1.20 |
| | | 100.0 | | | | | | | |
| Ex. 22 | | | | 28.0 | | | 70.80 | | 1.20 |
| | | | 100.0 | | | | | | |

TABLE 9-continued

| | La | Ce | Pr | Nd | Dy | Mm* | Fe | Co | B |
|---|---|---|---|---|---|---|---|---|---|
| Ex. 23 | | | | 28.0 | | | 70.80 | | 1.20 |
| | | | | 100.0 | | | | | |

In each Example, the composition of the main phase alloy ingot is shown in the upper part, while that of the sintering assist alloy ingot is shown in the lower part.
*Mm: Misch metal

TABLE 10

| | | | Main phase grain size (μm) | | | | | | | |
|---|---|---|---|---|---|---|---|---|---|---|
| | | | Long axis | | | | Short axis | | | |
| | Cooling rate (°C./Sec.) | Supercooling degree (°C.) | Max. Value | Min. Value | Average | Standard deviation | Max. Value | Min. Value | Average | Standard deviation |
| Ex. 5 | 5324 | 180 | 300 | 10 | 180 | 20 | 3 | 10 | 7 | 2 |
| | 3826 | 166 | | | | | | | | |
| Ex. 6 | 5324 | 180 | 300 | 50 | 160 | 30 | 10 | 5 | 7 | 2 |
| | 3826 | 166 | | | | | | | | |
| Ex. 7 | 5324 | 180 | 300 | 50 | 160 | 30 | 10 | 5 | 7 | 2 |
| | 3826 | 166 | | | | | | | | |
| Ex. 8 | 5324 | 180 | 300 | 50 | 160 | 30 | 10 | 5 | 7 | 2 |
| | 3826 | 166 | | | | | | | | |
| Ex. 9 | 4865 | 122 | 280 | 20 | 150 | 20 | 15 | 1 | 8 | 3 |
| | 3000 | 150 | | | | | | | | |
| Ex. 10 | 4865 | 122 | 280 | 20 | 150 | 20 | 15 | 1 | 8 | 3 |
| | 3000 | 150 | | | | | | | | |
| Ex. 11 | 4865 | 122 | 280 | 20 | 150 | 20 | 15 | 1 | 8 | 3 |
| | 3000 | 150 | | | | | | | | |
| Ex. 12 | 4865 | 122 | 280 | 20 | 150 | 20 | 15 | 1 | 8 | 3 |
| | 3000 | 150 | | | | | | | | |
| Ex. 13 | 5000 | 122 | 260 | 18 | 190 | 17 | 12 | 3 | 6 | 2 |
| | 3000 | 150 | | | | | | | | |
| Ex. 14 | 5000 | 122 | 260 | 18 | 190 | 17 | 12 | 3 | 6 | 2 |
| | 3000 | 150 | | | | | | | | |
| Ex. 15 | 5324 | 180 | 300 | 50 | 160 | 30 | 10 | 5 | 7 | 2 |
| | 3826 | 166 | | | | | | | | |
| Ex. 16 | 5324 | 180 | 300 | 50 | 160 | 30 | 10 | 5 | 7 | 2 |
| | 3826 | 166 | | | | | | | | |
| Ex. 17 | 5324 | 180 | 300 | 50 | 160 | 30 | 10 | 5 | 7 | 2 |
| | 3826 | 166 | | | | | | | | |
| Ex. 18 | 5324 | 180 | 300 | 50 | 160 | 30 | 10 | 5 | 7 | 2 |
| | 3000 | 150 | | | | | | | | |
| Ex. 19 | 5324 | 180 | 300 | 50 | 160 | 30 | 10 | 5 | 7 | 2 |
| | 3000 | 150 | | | | | | | | |
| Ex. 20 | 4865 | 122 | 280 | 20 | 150 | 20 | 15 | 1 | 8 | 3 |
| | 6554 | 292 | | | | | | | | |
| Ex. 21 | 4865 | 122 | 280 | 20 | 150 | 20 | 15 | 1 | 8 | 3 |
| | 6554 | 292 | | | | | | | | |
| Ex. 22 | 4865 | 122 | 280 | 20 | 150 | 20 | 15 | 1 | 8 | 3 |
| | 6554 | 292 | | | | | | | | |
| Ex. 23 | 4865 | 122 | 280 | 20 | 150 | 20 | 15 | 1 | 8 | 3 |
| | 6554 | 292 | | | | | | | | |

In each Example, the data of the main phase alloy ingot are shown in the upper part, while those of the sintering assist alloy ingot are shown in the lower part.

TABLE 11

| | Structural characteristic | | |
|---|---|---|---|
| | Grain size of α-Fe (μm) | Rare earch-enriched phase | Mixing ratio |
| Ex. 5 | Not observed | Uniform | 83 |
| | " | " | 17 |
| Ex. 6 | " | " | 96 |
| | " | " | 4 |
| Ex. 7 | " | " | 96 |
| | " | " | 4 |

TABLE 11-continued

| | Structural characteristic | | |
|---|---|---|---|
| | Grain size of α-Fe (μm) | Rare earch-enriched phase | Mixing ratio |
| Ex. 8 | " | " | 96 |
| | " | " | 4 |
| Ex. 9 | " | " | 96 |
| | " | " | 4 |
| Ex. 10 | " | " | 96 |
| | " | " | 4 |
| Ex. 11 | " | " | 96 |
| | " | " | |
| Ex. 12 | " | " | 96 |
| | " | " | 4 |
| Ex. 13 | " | " | 96 |
| | " | " | 4 |
| Ex. 14 | " | " | 96 |
| | " | " | 4 |
| Ex. 15 | " | " | 96 |
| | " | " | 4 |
| Ex. 16 | " | " | 96 |
| | " | " | 4 |
| Ex. 17 | " | " | 96 |
| | " | " | 4 |
| Ex. 18 | " | " | 96 |
| | " | " | 4 |
| Ex. 19 | " | " | 96 |
| | " | " | 4 |
| Ex. 20 | " | " | 97 |
| | " | " | 3 |
| Ex. 21 | " | " | 97 |
| | " | " | 3 |
| Ex. 22 | " | " | 97 |
| | " | " | 3 |
| Ex. 23 | " | " | 97 |
| | " | " | 3 |

In each Example, the data of the main phase alloy ingot are shown in the upper part, while those of the sintering assist alloy ingot are shown in the lower part.

TABLE 12

| | Magnetic characteristic | | |
|---|---|---|---|
| | Br (KG) | iHc (KOe) | (BH) max (MGOe) |
| Ex. 5 | 13.5 | 12.1 | 43.1 |
| Ex. 6 | 13.5 | 14.0 | 43.0 |
| Ex. 7 | 13.4 | 13.6 | 43.5 |
| Ex. 8 | 12.9 | 11.0 | 37.5 |
| Ex. 9 | 12.2 | 7.8 | 36.8 |
| Ex. 10 | 12.4 | 7.0 | 36.2 |
| Ex. 11 | 12.8 | 10.2 | 39.0 |
| Ex. 12 | 13.0 | 8.9 | 40.5 |
| Ex. 13 | 13.1 | 9.2 | 41.0 |
| Ex. 14 | 13.5 | 9.5 | 42.0 |
| Ex. 15 | 12.6 | 8.0 | 37.0 |
| Ex. 16 | 12.9 | 12.5 | 41.3 |
| Ex. 17 | 13.0 | 8.7 | 40.8 |
| Ex. 18 | 12.5 | 7.8 | 36.0 |
| Ex. 19 | 13.3 | 14.5 | 41.2 |
| Ex. 20 | 12.8 | 8.5 | 39.2 |
| Ex. 21 | 12.0 | 8.0 | 38.0 |
| Ex. 22 | 13.5 | 10.2 | 41.0 |
| Ex. 23 | 13.7 | 9.9 | 44.2 |

Although the present invention has been described with reference to the preferred examples, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A permanent magnet obtained by pulverizing, molding and sintering a starting material comprising 70 to 99.9 vol. % of an alloy ingot, said alloy ingot containing not less than 90% by volume of columnar crystals each having a columnar crystal grain size of 0.1 to 50 μm along a short axis thereof and a columnar crystal grain size of larger than 100 μm and not larger than 300 μm along a long axis thereof, said alloy ingot having been obtained by uniformly solidifying by a single roll method a molten alloy containing 25 to 31% by weight of a rare earth metal, 0.5 to 1.5% by weight of boron and iron under cooling conditions of a cooling rate of higher than 500° C./sec. and not higher than 10,000° C./sec. and a supercooling degree of 50° to 500° C.

2. The permanent magnet as claimed in claim 1 wherein said rare earth metal is selected from the group consisting of lanthanum, cerium, praseodymium, neodymium, yttrium, dysprosium, and mixtures thereof.

3. The permanent magnet as claimed in claim 1 wherein said molten alloy contains 67.5 to 74.5 wt % of iron.

4. The permanent magnet as claimed in claim 1 wherein said alloy ingot has a thickness of 0.05 to 5 mm.

5. The permanent magnet as claimed in claim 1 wherein said alloy ingot is free from α-Fe and γ-Fe in its main phase crystal grain.

6. The permanent magnet as claimed in claim 1 wherein said alloy ingot contains peritectic nuclei selected from the group consisting of α-Fe, γ-Fe and mixtures thereof in its main phase crystal grain in a finely dispersed state, said α-Fe and γ-Fe having a crystal grain size of less than 10 μm.

7. The permanent magnet as claimed in claim 1 wherein said starting material contains 0.1 to 30 vol % of an additional metal ingot, said additional metal ingot containing 31 to 100 wt % of an additional rare earth metal based on said additional metal ingot.

8. The permanent magnet as claimed in claim 7 wherein said additional rare earth metal is selected from the group consisting of lanthanum, cerium, praseodymium, neodymium, yttrium, dysprosium, and mixtures thereof.

9. The permanent magnet as claimed in claim 7 wherein said additional metal ingot contains not more than 69 wt % of an additional metal selected from the group consisting of iron, cobalt, nickel and mixtures thereof.

10. The permanent magnet as claimed in claim 1 wherein said starting material has been crushed to a size of 24 to 250 meshes and further pulverized to a size of not more than 10 μm.

11. The permanent magnet as claimed in claim 1 wherein said starting material has been molded under a pressure of 100 to 200 MPa at a magnetic field strength of 1200 $KAm^{-1}$ or higher.

12. The permanent magnet as claimed in claim 1 wherein said starting material has been sintered at 1000° to 1200° C. for 0.5 to 5 hours in an atmosphere selected from the group consisting of an inert gas and vacuum.

13. The permanent magnet as claimed in claim 1 wherein said starting material has been sintered and then heat-treated at 400° to 600° C. for 0.5 to 5 hours.

14. The permanent magnet obtained by pulverizing, molding and sintering a starting material comprising 70 to 100 vol. % of an alloy ingot, said alloy ingot containing not less than 90% by volume of columnar crystals each having a columnar crystal grain size of 0.1 to 50 μm along a short axis thereof and a columnar crystal grain size of larger than 100 μm and not larger than 300 μm along a long axis thereof, said alloy ingot having been obtained by uniformly solidifying by a single roll method a molten alloy containing 25 to 31% by weight of a rare earth metal, 0.5 to 1.5% by weight of boron and iron under cooling conditions of a cooling rate of higher than 500° C./sec. and not higher than 10,000° C./sec. and a super cooling degree of 50° to 500° C.

15. The permanent magnet as claimed in claim 1 or 14 wherein said molten alloy contains 30 wt % or less of an additional component and 37.5 wt % or more of iron, said additional component having been selected from the group consisting of cobalt, aluminum, chromium, manganese, magnesium, silicon, copper, carbon, tin, tungsten, vanadium, zirconium, titanium, molybdenum, niobium, gallium and mixtures thereof.

16. The permanent magnet as claimed in claim 14, wherein said rare earth metal is selected from the group consisting of lanthanum, cerium, praseodymium, neodymium, yttrium, dysprosium, and mixtures thereof.

17. The permanent magnet as claimed in claim 14, wherein said molten alloy contains 67.5 to 74.5 wt % of iron.

18. The permanent magnet as claimed in claim 14, wherein said molten alloy contains 30 wt % or less of an additional component and 37.5 wt % or more of iron, said additional component having been selected from the group consisting of cobalt, aluminum, chromium, manganese, magnesium, silicon, copper, carbon, tin, tungsten, vanadium, zirconium, titanium, molybdenum, niobium, gallium and mixtures thereof.

19. The permanent magnet as claimed in claim 14, wherein said alloy ingot has a thickness of 0.05 to 5 mm.

20. The permanent magnet as claimed in claim 14, wherein said alloy ingot is free from α-Fe and γ-Fe in its main phase crystal grain.

21. The permanent magnet as claimed in claim 14, wherein said alloy ingot contains peritectic nuclei selected from the group consisting of α-Fe, γ-Fe and mixtures thereof in its main phase crystal grain in a finely dispersed state, said α-Fe and γ-Fe having a crystal grain size of less than 10 μm.

22. The permanent magnet as claimed in claim 14, wherein said starting material contains 0 to 30 vol % of an additional metal ingot, said additional metal ingot containing 31 to 100 wt % of an additional rare earth metal based on said additional metal ingot.

23. The permanent magnet as claimed in claim 22, wherein said additional rare earth metal is selected from the group consisting of lanthanum, cerium, praseodymium, neodymium, yttrium, dysprosium, and mixtures thereof.

24. The permanent magnet as claimed in claim 22, wherein said additional metal ingot contains not more than 69 wt % of an additional metal selected from the group consisting of iron, cobalt, nickel and mixtures thereof.

25. The permanent magnet as claimed in claim 14, wherein said starting material is crushed to a size of 24 to 250 meshes and further pulverized to a size of not more than 10 μm.

26. The permanent magnet as claimed in claim 14, wherein said starting material is molded under a pressure of 100 to 200 MPa at a magnet field strength of 1200 $KAm^{-1}$ or higher.

27. The permanent magnet as claimed in claim 14, wherein said starting material is sintered at 1000° to 1200° C. for 0.5 to 5 hours in an atmosphere selected from the group consisting of an inert gas and vacuum.

28. The permanent magnet as claimed in claim 14, wherein said starting material is sintered and then heat-treated at 400° to 600° C. for 0.5 to 5 hours.

* * * * *